United States Patent [19]

Pelcin

[11] 4,231,597

[45] Nov. 4, 1980

[54] FLUSH-TYPE DOOR LOCK

[75] Inventor: Albert L. Pelcin, Aurora, Ohio

[73] Assignee: The Eastern Company, Cleveland, Ohio

[21] Appl. No.: 903,164

[22] Filed: May 5, 1978

Related U.S. Application Data

[63] Continuation-in-part of Ser. No. 785,412, Apr. 7, 1977, abandoned, which is a continuation-in-part of Ser. No. 729,199, Oct. 4, 1976, abandoned.

[51] Int. Cl.[2] ..... E05B 5/00; E05C 1/00

[52] U.S. Cl. ..... 292/164; 70/144; 70/150; 292/143; 292/147; 292/173; 292/DIG. 31

[58] Field of Search ..... 70/208, 134, 129, 144, 70/150, 478, 489; 292/143, 147, 173, 252, 74, DIG. 31, 164, 137, 164

[56] References Cited

U.S. PATENT DOCUMENTS

| | | | |
|---|---|---|---|
| 1,616,609 | 2/1927 | Davis | 292/164 |
| 2,264,962 | 12/1941 | Adams | 292/147 |
| 2,649,322 | 8/1953 | Mack | 292/173 |
| 2,697,626 | 12/1954 | Cheney | 292/173 |
| 2,763,503 | 9/1956 | Tasch et al. | 292/DIG. 31 |
| 2,916,905 | 12/1959 | Podlesak | 70/150 |
| 2,987,908 | 6/1961 | Pelcin | 70/208 X |
| 3,044,815 | 7/1962 | Soss | 292/173 |
| 3,563,584 | 2/1971 | Schwartzman | 292/74 |
| 3,707,862 | 1/1973 | Pastva, Jr. | 70/150 |
| 3,745,796 | 8/1973 | Fleming | 70/208 |
| 3,806,175 | 4/1974 | Van Herpen | 292/147 |
| 4,098,101 | 7/1978 | Svoboda | 292/143 X |

FOREIGN PATENT DOCUMENTS

| | | | |
|---|---|---|---|
| 991571 | 6/1951 | France | 292/147 |
| 1017570 | 1/1966 | United Kingdom | 292/147 |
| 1140758 | 1/1969 | United Kingdom | 292/143 |

*Primary Examiner*—Roy D. Frazier
*Assistant Examiner*—Carl F. Pietruszka
*Attorney, Agent, or Firm*—Burge & Porter Co.

[57] ABSTRACT

A flush mountable door lock includes a recessed body member, a lock bolt slidably mounted on the body member, and a paddle-shaped operating handle for moving the bolt. The handle is movable between nested and projected positions. A bolt actuator extends from the handle into a receiving formation provided on the bolt for drivingly interconnecting the handle and the bolt to effect retracting and extending movements of the bolt when the handle is moved toward its projected and retracted positions. A torsion coil spring is interposed between the body member and the handle, and serves the several functions of biasing the handle toward its nested position, maintaining play-free engagement between the handle and the body member when the handle is nested, and maintaining a play-free driving connection between the handle and the bolt when the handle is projected. A ball-spring detent system is interposed between the body member and the bolt, and serves the several functions of assisting in effecting final movement of the bolt to its extended and retracted positions as the bolt approaches these positions, releasably retaining the bolt in its extended position when the handle is nested, and releasably retaining the bolt in its retracted position when the handle is projected. The ball-spring detent system preferably includes a hardened steel ball carried in a closed-ended hole provided in the bolt. A compression coil spring is carried in the closed-ended hole and biases the ball outwardly of the closed-ended hole for selective engagement with spaced formations provided on the body member. One or more plastic inserts carried in the bolt may define the closed-ended hole and/or may define at least a part of the actuator receiving formation.

15 Claims, 9 Drawing Figures

FLUSH-TYPE DOOR LOCK

CROSS-REFERENCE TO RELATED APPLICATIONS

The present application is a continuation-in-part of application Ser. No. 785,412 filed Apr. 7, 1977, which was, in turn, a continuation-in-part of application Ser. No. 729,199 filed Oct. 4, 1976, both of which prior applications are now abandoned, the disclosures of which are incorporated herein by reference.

BACKGROUND OF THE INVENTION

1. Field of the Invention

The present invention relates to flush-type door locks for use on swinging doors or trucks, industrial cabinets and the like.

2. Prior Art

Flush-type door locks including a housing, a slidable lock bolt, and an operating handle for moving the bolt relative to the housing are well-known. Usually the handle is in a flush or nested position when the bolt is extended, and pivots to a projected position when the bolt is retracted. Locks of this type are especially suited for use on swinging doors of vehicles such as trucks, on merchandise, tool and equipment cabinets, and the like.

Some flush-type lock proposals have included mechanisms for releasably retaining the handle and the bolt in their respective nested and projected, extended and retracted positions. The handle and bolt retaining mechanisms employed in such proposals have typically suffered from a number of drawbacks including such disadvantages as being complex and expensive to fabricate and assemble. Precisely formed parts have been used to provide locks which have little play between their movable parts, and which will not rattle when subjected to vibration.

SUMMARY OF THE INVENTION

The present invention overcomes the foregoing and other drawbacks of the prior art, and provides a novel and improved flush-type door lock of simple construction which can be quickly and easily installed. The lock is of rugged, durable construction, and comprises a relatively small number of parts which, for the most part, are inexpensively formed stampings and castings.

Door locks embodying the preferred practice of the present invention include a body member having side and back walls which cooperate to define a forwardly facing recess. An opening is formed through the back wall. An elongate bolt is slidably supported on the body member at a location behind a portion of the back wall. The bolt is movable between an extended position wherein one end of the bolt is extended with respect to the body member, and a retracted position wherein the bolt is retracted with respect to the body member. A key control may be mounted on the body member. The key control carries a cam which is movable between a locked position wherein the cam prevents movement of the bolt to its retracted position, and an unlocked position wherein the cam permits movement of the bolt to its retracted position. A handle is mounted on the body member and is movable between a nested position wherein the handle is nested within the recess, and a projected position wherein a substantial portion of the handle projects from the recess. A detent is interposed between the body member and the bolt for selectively releasably retaining the bolt in its retracted and extended positions. The detent also serves the function of assisting in effecting final movements of the bolt to its extended and retracted positions as the bolt approaches these positions.

A driving connection is formed between the handle and the bolt by an actuator which extends through the opening formed in the back wall of the body member and into a receiving formation provided on the bolt. The driving connection provided between the actuator and the bolt is operable to move the bolt toward its retracted position when the handle is moved toward its projected position, to move the bolt toward its extended position when the handle is moved toward its nested position, and to retain the handle in its projected position when the bolt is retained in its retracted position by the detent. A handle biasing spring is interposed between the body member and the handle for biasing the handle toward its nested position, for maintaining play-free engagement between the handle and the body member when the bolt is in its extended position, and for maintaining a play-free driving connection between the handle actuator and the bolt when the bolt is in its retracted position.

A feature of this combination and arrangement of parts is that very few if any of the parts require precision machining. Any play which occurs between the relatively movable parts is overcome by the operation of the detent and the handle spring. None of the relatively movable parts are free to rattle when the lock is subjected to vibration. When the handle is nested and the bolt is extended, the handle spring maintains rattle-free engagement between the handle and body member, and the detent maintains the rattle-free engagement between the bolt and the body member. The engagement which is established between the handle and the body member determines the nested position of the handle. The engagement which is established between the bolt-carried detent and the body member determines the extended position of the bolt.

The detent preferably includes a hardened steel ball carried in a closed-ended hole. The closed-ended hole may be formed directly in the material of the bolt itself, or may be formed in a generally cylindrical plastic mounting sleeve which is pressed into and carried within a throughhole formed in the bolt. A compression coil spring is carried in the closed-ended hole and biases the ball outwardly toward the body member. Spaced holes or depressions are formed in the body member and receive the ball when the bolt is in either of its retracted or extended positions. The biasing action of the compression coil spring tends to force the ball into one of the holes or depressions as the bolt approaches either of its extended or retracted positions. This biasing action is quite strong and is utilized to assist in effecting final movement of the bolt to its extended and retracted positions. In fact, as the handle approaches its nested position during movement of the bolt to its extended position, it is the strong biasing action of the detent which effects final movement of the bolt to its extended position. When the handle is nested and the bolt is extended, the handle actuator is preferably out of engagement with the bolt.

The spaced holes or depressions which are formed in the body member to receive the detent ball may be of differing configuration to provide greater and lesser degrees of retention force depending on which of the formations is engaged by the detent ball. In preferred practice, the recess or depression, which is engaged by the detent ball when the bolt is extended, is configured to more fully receive the detent ball than is the recess or depression which is engaged by the detent ball when the bolt is retracted. By this arrangement, the bolt is more securely retained in its extended position than in its retracted position. Greater retention force is desirable when the bolt is in its extended position to assure that the bolt is held firmly in its extended position in the presence of vibration.

The receiving formation provided on the bolt for receiving the handle actuator is preferably defined, at least in part, by a plastic insert carried in an opening formed in the bolt. The use of one or more plastic inserts to carry components of the detent and/or to receive the handle actuator promotes smooth operation of the lock components and permits their formation at relatively low cost. Where inserts are used, larger mounting formations can be provided in the bolt to receive the inserts (relatively large formations can be cast with less expense than relatively small ones) and the inserts can serve to effectively reduce the size of the mounting formations as may be needed for the mounting of detent components and/or for receiving the handle actuator.

As will be apparent from the foregoing summary, it is a general object of the present invention to provide a novel and improved, flush-mountable door lock.

These and other objects and a fuller understanding of the invention described in the present application may be had by referring to the following description and claims taken in conjunction with the accompanying drawings.

DESCRIPTION OF THE PREFERRED EMBODIMENT

Figure 1:
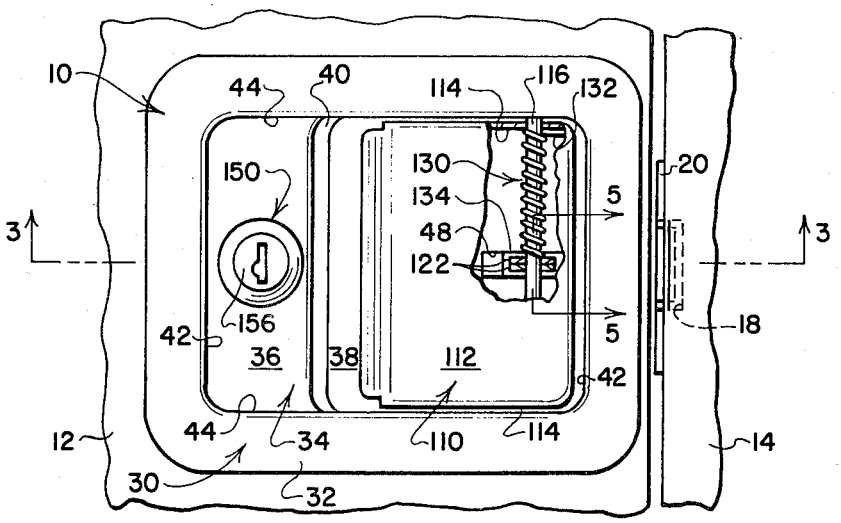
FIG. 1 is a front elevational view of a door lock embodying one practice of the present invention mounted in a swinging door and engaging a door frame, with portions of the lock being broken away and shown in a cross section.
Figure 2:
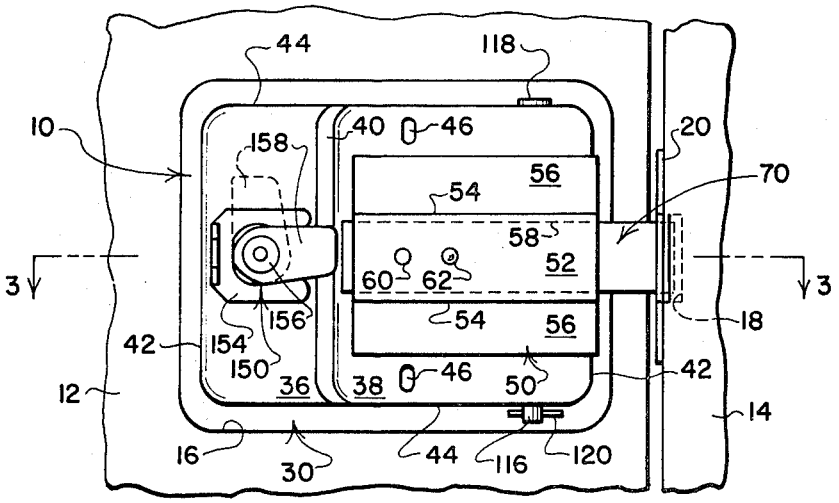
FIG. 2 is a rear elevational view of the door lock installation of FIG. 1 with one extreme position of a key-controlled cam shown in phantom.
Figure 3:
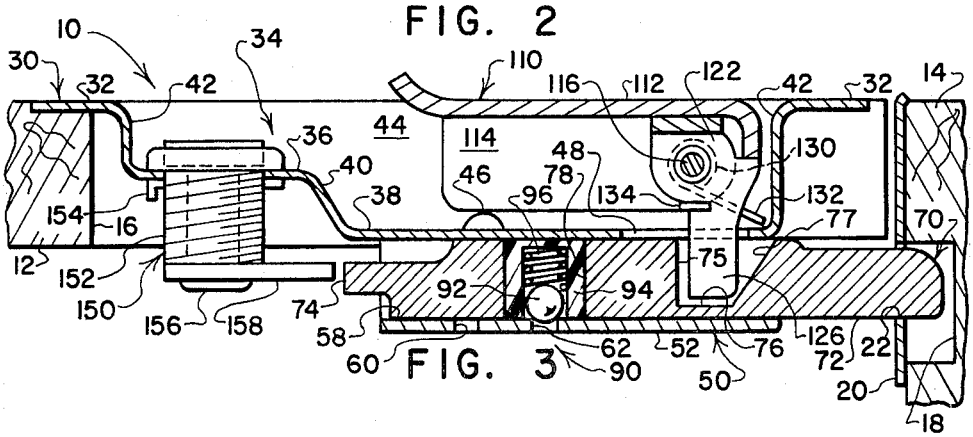
FIG. 3 is a sectional view as seen from a plane indicated by lines 3—3 in FIGS. 1 and 2.

Referring to FIGS. 1–3, a key-controlled, flush-type lock embodying one form of the present invention is indicated generally by the numeral 10. The lock 10 is shown supported on a swinging door portion 12 adjacent a door frame 14. An opening 16 is formed through the door portion 12. A recess 18 is formed in the door frame 14. A striker plate 20 is mounted on the door frame 14 and has a bolt-receiving opening 22 aligned with the recess 18.

The lock 10 comprises, in general, a recessed body structure including a body member 30 and a bolt housing 50 welded to the rear side of the body member 30, a bolt 70 slidable in the bolt housing 50, a detent system 90 for selectively retaining the bolt 70 in retracted and extended positions, a handle 110 pivotally mounted on the body member 30 and operable when moved between nested and projected positions to retract and extend the bolt 70, a torsion spring 130 biasing the handle 110 toward its nested position, and a key-operated control 150 for selectively permitting and preventing movement of the bolt 70 to its retracted position.

The body member 30 is a rectangular pan-shaped sheet metal stamping having a perimetrically extending flange 32 which surrounds a recess 34. Left and right back wall portions 36, 38 define different depth levels in opposite end portions of the recess 34, and an inclined wall portion 40 interconnects the back wall portions 36, 38. Upstanding end walls 42 and sidewalls 44 connect the back wall portions 36, 38 with the flange 32. A pair of stop formations 46 are formed in the right wall portion 38 and project into the recess 34 at locations along the sidewalls 44. An elongate slot 48 is formed in the right wall portion 38 at a location overlying the bolt 70.

The bolt housing 50 is a channel-shaped sheet metal stamping having a bottom wall 52, a pair of opposed sidewalls 54, and a pair of flanges 56. The flanges 56 project outwardly from the sidewalls 54 and are welded to the back side of the right wall portion 38. The bolt housing 50 cooperates with the body member 30 to define an elongate, open-ended passage 58 within which the bolt 70 is slidably mounted. Two holes 60, 62 are formed through the bottom wall 52 at equally spaced locations along the passage 58.

The bolt 70 is a solid, cast, metal member having a generally rectangular cross section which corresponds to that of the passage 58. The bolt 70 is movable between an extended position shown in FIG. 3, and a retracted position shown in FIG. 4. The bolt 70 has a right end region 72 of slightly reduced cross section, and a left end region 74 of substantially reduced cross section. When the bolt 70 is extended, the right end region 72 projects through the striker plate opening 22 and prevents the door 12 from swinging open. When the bolt 70 is retracted, the right end region 72 is withdrawn from engagement with the striker plate 20 and the door 12 can be moved relative to the door frame 14.

An actuator-receiving formation 76 and a detent mounting formation 78 are provided in central portions of the bolt 70. The actuator-receiving formation 76 is a forwardly opening elongate recess which communicates with the body member slot 48. The recess 76 has a left end wall 75 and a right end wall 77, as viewed in FIGS. 3 and 4. The detent mounting formation 78 is a hole formed through the bolt 70. When the bolt 70 is retracted, the recess 76 communicates with the left end of the slot 48 and the hole 78 aligns with the hole 60. When the bolt 70 is extended, the recess 76 communicates with the right end of the slot 48 and the hole 78 aligns with the hole 62.

Figure 4:
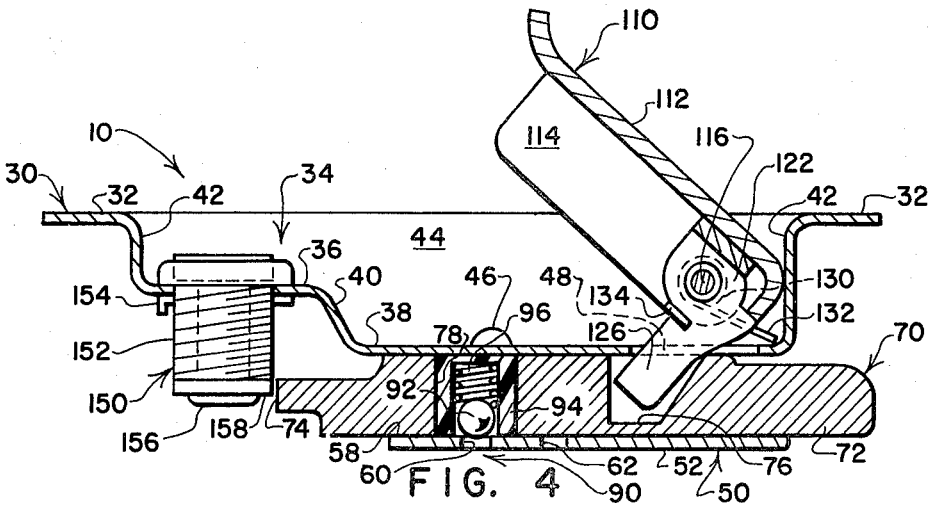
FIG. 4 is a sectional view similar to FIG. 3 with the lock handle in its open position and the lock bolt retracted.

Referring to FIGS. 3 and 4, the detent system 90 includes a hardened steel ball 92 carried in a mounting sleeve 94 positioned in the hole 78. The mounting sleeve 94 is of generally cylindrical shape and is press-fitted into the hole 78. The mounting sleeve 94 is formed from plastics material and is preferably injection-molded to minimize its expense. A compression coil spring 96 biases the ball 92 rearwardly (downwardly as viewed in FIGS. 3 and 4) toward the bottom wall 52. When the bolt 70 is retracted, the ball 92 projects into the bottom wall hole 60 and releasably retains the bolt 70 in its retracted position. When the bolt 70 is extended, the ball 92 projects into the bottom wall hole 62 and releasably retains the bolt 70 in its extended position.

Referring to FIGS. 1 and 3, the paddle-shaped handle 110 is a sheet metal stamping having a generally rectangular, substantially flat plate portion 112 and a pair of inturned flanges 114. The flanges 114 lie adjacent the body member sidewalls 44. A hinge pin 116 extends through aligned holes formed in the flanges 114 and in the sidewalls 44, and pivotally mounts the handle 110 on the body member 30. As is best seen in FIG. 2, an enlarged diameter head 118 is formed on one end region of the pin 116, and a cotter pin 120 extends through a hole formed in the other end region of the pin 116.

Figure 5:
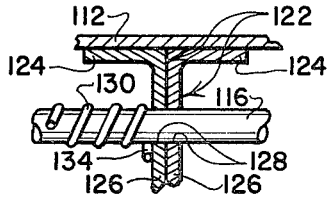
FIG. 5 is an enlarged sectional view as seen from a plane indicated by a line 5—5 in FIG. 1.

A pair of bolt actuating arms 112 are welded to the back side of the flat plate portion 112, project through the body member slot 48, and extend into the bolt recess 76. As is best seen in FIG. 5, the arms 122 are of L-shaped configuration, having mounting legs 124 welded to the flat plate portion 112, and side-by-side depending leg portions 126. Aligned holes 128 are formed in the depending leg portions 126, and the hinge pin 116 extends through these holes.

The handle 110 is pivotally movable about the axis of the pin 116 between a flush or nested position shown in FIG. 3, and a projected or open position shown in FIG. 4. The depending portions 126 of the bolt operating arms 122 form a driving connection between the handle 110 and the bolt 70. When the handle 110 is pivoted toward its projected position, the depending portions 126 engage the left end wall 75 of the recess 76 and cause the bolt 70 to slide toward its retracted position. When the handle 110 is pivoted toward its nested position, the depending portions 126 engage the right end wall 77 of the recess 76 and cause the bolt 70 to slide toward its extended position. When the handle 110 is nested, the inturned flanges 114 engage the stops 46 and the depending portions 126 engage neither of the end walls 75, 77.

The torsion coil spring 130 is coiled around the hinge pin 116. The spring 130 has one straight end region 132 which extends away from the hinge pin and engages the body member wall portion 38, as best seen in FIGS. 3 and 4. The other end 134 of the spring 130 is of U-shaped configuration and wraps around the depending leg portions 126. The spring 130 biases the handle 110 toward its nested position.

The key-operated control 150 includes a lock mounting cylinder 152 of non-circular shape mounted in a non-circular hole formed through the body member wall portion 36. The configuration of the lock cylinder 152 and its mounting hole are such that the lock cylinder 152 will not rotate relative to the body member 30. A spring clip 154 holds the lock cylinder 152 in place on the body member 30.

The cylinder 152 supports a key-actuable, rotatable lock component 156 which is rotatable through an angle of 90 degrees. A cam member 158 is secured to one end of the rotatable lock component 156 and is movable therewith between a locked position shown in solid lines in FIG. 2, and an unlocked position shown in phantom in FIG. 2. When the cam member 158 is in its locked position, it prevents the bolt 70 from moving to its retracted position. When the cam member 158 is in its unlocked position, it permits movement of the bolt 70 to its retracted position.

The described combination and arrangement of lock components provides a lock construction which comprises a relatively small number of parts, very few of which require precision machining. While there is an inherent amount of play in the driving connection formed between the handle 110 and the bolt 70 due to the loose fit of the depending arm portions 126 in the bolt recess 76, the detent means 90 and the torsion spring 130 cooperate in a unique fashion to overcome problems which would otherwise result from such play. The detent system 90 releasably holds the bolt 70 in position relative to the body member 30 and prevents the bolt 70 from rattling in the presence of vibration. The detent system 90 also operates to releasably hold the handle 110 in its projected position. The torsion spring 130 not only biases the handle 110 toward its nested position but also (1) maintains play-free engagement between the handle 110 and the body member 30 when the handle is nested, and (2) maintains a play-free driving connection between the handle 110 and the bolt 70 when the handle is in its projected position. The multi-function use of these several components simplifies the construction of the lock 10 and permits the use of large tolerance, non-machined components.

The detent system 90 also functions to assist in effecting final movement of the bolt 70 to its extended and retracted positions. As will be appreciated, when the ball 92 begins its entry into one of the holes 60, 62, the strong biasing action of the spring 96 will tend to project the ball 92 rapidly into the hole, thereby causing the bolt 70 to move as is needed to permit maximum projection of the ball 92 into the hole.

Figure 6:
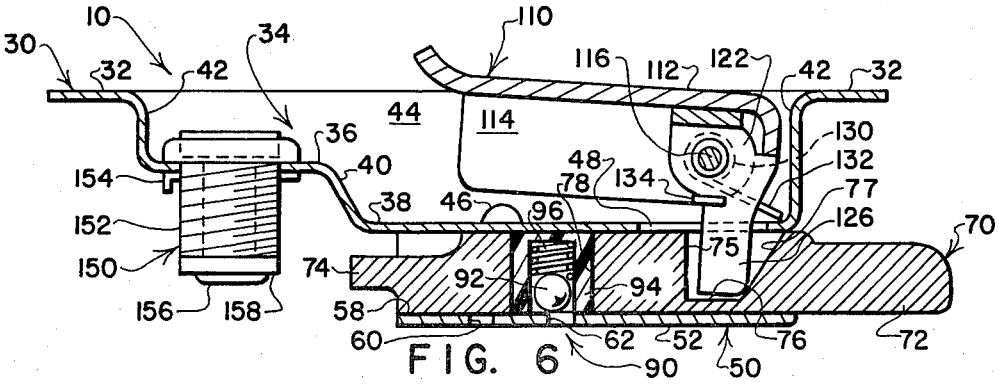
FIG. 6 is a sectional view similar to FIG. 3 showing the lock bolt approaching its extended position and the handle approaching its nested position.

Referring to FIG. 6, as the bolt 70 approaches its extended position and as the handle 110 approaches its nested position, a condition is reached where the ball 92 starts to enter the hole 62. When this condition is reached, the strong biasing action of the spring 96 will cause the bolt 70 to move quite rapidly to its fully extended position where the ball 92 is fully seated in the hole 62, as illustrated in FIG. 3. During this rapid movement of the bolt 70 and as the handle assumes its nested position, the depending portions 126 disengage the end walls 75, 77 of the recess 76.

The disengagement between the bolt 70 and the handle 110 (i.e., between the depending portions 126 and the end walls 75, 77) which occurs when the bolt is extended and the handle is nested is advantageous in that it permits the extended position of the bolt 70 and the nested position of the handle 110 to be determined independently of each other. The extended position of the bolt 70 is determined by the bolt position at which the ball 92 is fully seated in the hole 62. The nested position of the handle 110 is determined by the handle position at which the handle flanges 114 engage the body projections 46. Since the extended and nested positions of the bolt and handle, respectively, are not determined by an interaction of these two relatively movable components, accurate independent positioning of the bolt 70 and the handle 110 is achieved even though these components themselves may be formed relatively inexpensively using large tolerance, non-machined components.

Several advantages obtain by housing the ball 92 and the spring 96 in the plastic mounting sleeve 94. The use of the sleeve 94 minimizes the need for lubrication of the ball 92 and provides a lock with excellent operator "feel" due to the smooth, quiet mannerism in which the ball 92 moves within the mounting sleeve 94. The sleeve 94 is inexpensive to form and provides an extremely simple manner of establishing a closed-ended mounting hole in the bolt 70 for carrying the ball 92 and the spring 96. By using the sleeve 94, the need is eliminated to form a relatively small diameter closed-ended hole in the bolt to directly mount the ball 92 and the spring 96. Where the sleeve 94 is used, a relatively large diameter, inexpensive-to-form hole is all that needs to be provided in the bolt 70.

As will be apparent to those skilled in the art, modifications can be made in the described lock embodiment without departing from the spirit of the invention. For example, a pair of spring-biased ball detents can be used in place of the described single ball detent system. Similarly, depression-like formations can be provided in the bolt housing 50 in place of the holes 60, 62 to receive the ball 92. Other modifications will be apparent.

Figure 7:
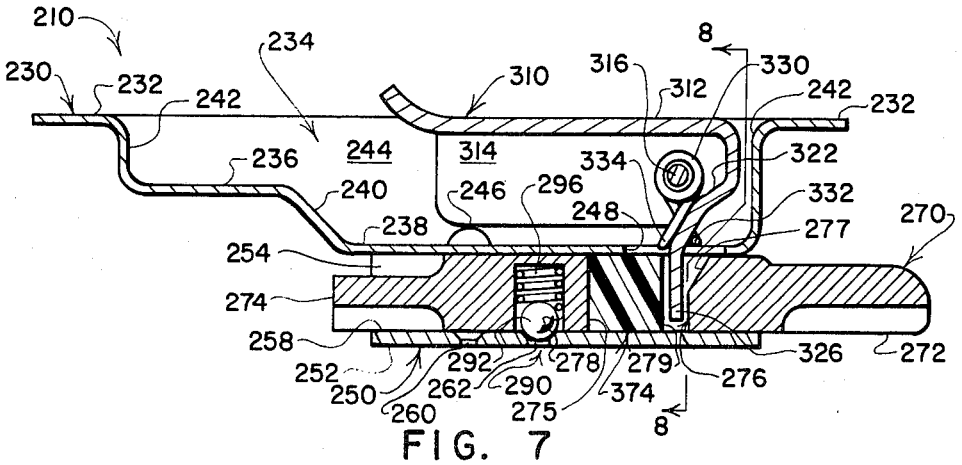
FIG. 7 is a sectional view similar to FIG. 3 of a door lock embodying the preferred practice of the present invention.
Figure 8:
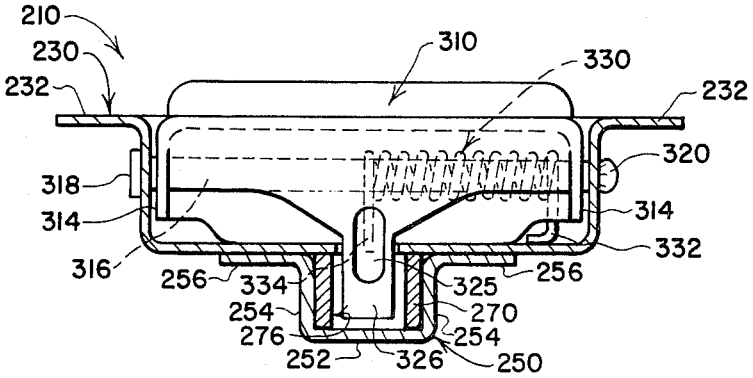
FIG. 8 is a sectional view as seen from planes indicated by a broken line 8—8 in FIG. 7; and, FIG. 9 is a view presenting an enlargement of a portion of the sectional view of FIG. 7.

Referring to FIGS. 7 and 8, an alternate embodiment of a lock incorporating the preferred practice of the present invention is indicated generally by the numeral 210. The lock 210 is identical to the lock 10 in most structural respects and in its operational characteristics. Since most of the components of the locks 10, 210 are identical or at least correspond in function, corresponding reference numerals differing by a magnitude of two hundred are used to indicate corresponding components of the locks 10, 210.

The lock 210 principally differs from the lock 10 in the following ways. First, no key control is included in the lock 210 though one could be. Second, the configuration of a handle actuating portion 326 employed in the lock 210 is simpler and less expensive to form than are the depending portions 126 utilized in the lock 10. Third, the configuration of an opening 276 formed in the bolt 270 to receive the handle actuator 326 is different than the configuration of the bolt opening 76 utilized in the lock 10. Additionally, a plastic insert member 274 is inserted in the opening 276 to shorten the effective length of this opening. Furthermore, a closed-ended hole 278 is formed directly in the bolt 270 to carry a detent ball and spring 292, 296, whereas the lock embodiment 10 utilizes the plastic sleeve 94 to define a closed-ended hole for carrying the detent ball and spring 92, 96.

The lock 210 comprises, in general, a recessed body structure including a body member 230 and a bolt housing 250 welded to the rear side of the body member 230, a bolt 270 slidable in the bolt housing 250, a detent system 290 for selectively retaining the bolt 270 in retracted and extended positions, a handle 310 pivotally mounted on the body member 230 and operable when moved between nested and projected positions to retract and extend the bolt 270, and a torsion spring 330 biasing the handle 310 toward its nested position.

The body member 230 is a rectangular pan-shaped sheet metal stamping having a perimetrically extending flange 232 which surrounds a recess 234. Left and right back wall portions 236, 238 define different depth levels in opposite end portions of the recess 234, and an inclined wall portion 240 interconnects the back wall portions 236, 238. Upstanding end walls 242 and sidewalls 244 connect the back wall portions 236, 238 with the flange 232. A pair of stop formations 246 are formed in the right wall portion 238 and project into the recess 234 at locations along the sidewalls 244. An elongate slot 248 is formed in the right wall portion 238 at a location overlying the bolt 270.

Figure 9:
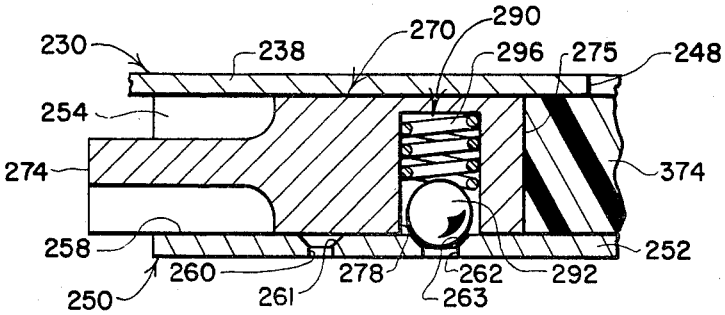

The bolt housing 250 is a channel-shaped sheet metal stamping having a bottom wall 252, a pair of opposed sidewalls 254, and a pair of flanges 256. The flanges 256 project outwardly from the sidewalls 254 and are welded to the back side of the right wall portion 238. The bolt housing 250 cooperates with the body member 230 to define an elongate, open-ended passage 258 within which the bolt 270 is slidably mounted. Two holes 260, 262 are formed through the bottom wall 252 at equally spaced locations along the passage 258. As is best seen in FIG. 9, the hole 262 is of larger diameter than the hole 260. The holes 260, 262 have enlarged, tapered inner end portions 261, 263 facing toward the bolt 270.

The bolt 270 is a solid, cast metal member having a generally rectangular cross section which corresponds to that of the passage 258. The bolt 270 is movable between an extended position shown in FIG. 7 and a retracted position which, although it is not illustrated, corresponds to the retracted position illustrated in FIG. 4 for the bolt 70. The bolt 270 has a right and left end regions 272, 274 of reduced cross section. When the bolt 270 is extended, the right end region 272 projects beyond the right portion of the housing flange 232 and is adapted to be received in a striker plate opening of the type indicated by the numeral 22 in FIG. 3. When the bolt 270 is retracted, the right end region 272 is withdrawn from engagement with such a striker plate as is indicated by the numeral 20 in FIG. 3, and the door on which the lock 210 is mounted can be moved relative to the door frame which supports the striker plate.

An actuator-receiving formation 276 and a detent mounting formation 278 are provided in central portions of the bolt 270. The actuator-receiving formation 276 is a through-slot which communicates with the body member slot 248. The slot 276 has a left end wall 275 and a right end wall 277, as viewed in FIG. 7. The detent mounting formation 276 is a closed-ended hole formed in the bolt 270 and opening toward the bolt housing bottom wall 252. When the bolt 270 is retracted, the slot 276 communicates with the left end of the slot 248 and the hole 278 aligns with the hole 260. When the bolt 270 is extended, the slot 276 communicates with the right end of the slot 248 and the hole 278 aligns with the hole 262.

A relatively cube-shaped plastic insert 374 is positioned in the slot 374 and abuttingly engages the left end wall 275. The plastic insert 274 presents a right end wall 279 located at a spaced distance from the right end wall 277 of the slot 374. The insert 274 is preferably formed from a hard, durable plastics material such as an acetal resin plastic sold by DuPont under the trademark DELRIN 500.

Referring to FIGS. 7 and 9, the detent system 290 includes a hardened steel ball 292 positioned in the hole 278. A compression coil spring 296 biases the ball 292 rearwardly (downwardly as viewed in FIGS. 7 and 9) toward the bottom wall 252. When the bolt 270 is retracted, the ball 292 projects into the bottom wall hole 260 and releasably retains the bolt 270 in its retracted position. When the bolt 270 is extended, the ball 292 projects into the bottom wall hole 262 and releasably retains the bolt 270 in its extended position. Inasmuch as the bottom wall hole 262 is of larger diameter than the bottom wall hole 260, the extent of the detent action, i.e. the magnitude of the retaining force acting on the bolt 270 by virtue of the ball 292 being received relatively fully in the large diameter tapered portion of 263 of the hole 262, is greater than the magnitude of the detent action or retaining force which is occasioned when the ball 292 is received in the bottom wall hole 260.

Referring to FIGS. 7 and 8, the paddle-shaped handle 310 is a sheet metal stamping having a generally rectangular, substantially flat plate portion 312 and a pair of inturned flanges 314. The flanges 314 lie adjacent the body member sidewalls 244. A hinge pin 316 extends through aligned holes formed in the flanges 314 and in the sidewalls 244, and pivotally mounts the handle 310 on the body member 230. As is best seen in FIG. 8, an enlarged diameter head 318 is formed on one end region of the pin 316, and the other end of the pin is crimped, as indicated generally by the numeral 320, to retain the pin 316 in position.

The handle is provided with an integrally formed actuating portion indicated generally by the numeral 322. The depending portion 326 comprises the lower end of the actuating portion 322 and extends into the space provided between the right wall 279 of the plastic insert 374 and the right wall 277 of the bolt slot 276.

The handle 310 is pivotally movable about the axis of the pin 316 between a flush or nested position shown in FIG. 3, and a projected or open position which corresponds to the projected or open position of the handle 110 illustrated in FIG. 4. The depending portion 326 forms a driving connection between the handle 310 and the bolt 270. When the handle 310 is pivoted toward its projected position, the depending portion 326 engages the right end wall 279 of the plastic insert 274 and causes the bolt 270 to slide toward its retracted position. When the handle 310 is pivoted toward its nested position, the depending portion 326 engages the right end wall 277 of the slot 276 and causes the bolt 270 to slide toward its extended position. When the handle 310 is nested, the inturned flanges 314 engage the steps 246 and the depending portion 326 engages neither of the end walls 275, 277.

The torsion coil spring 330 is coiled around the hinge pin 316. The spring 330 has one end region 332 which extends away from the hinge pin and engages the body member wall portion 238, as is best seen in FIGS. 7 and 8. The other end 334 of the spring 330 abuttingly engages the actuating portion 322 at a location above the depending portion 326. The actuating portion 322 may be provided with a slight dimple 325, as best seen in FIG. 8, and the end portion 334 may extend into the dimple 325 to facilitate its being retained in engagement with the actuating portion 322. The spring 330 biases the handle 310 toward its nested position.

The combination and arrangement of components provided by the lock 210 operates substantially identically as the combination and arrangement of lock components provided by the lock 10. While there is an inherent amount of play in the driving connection formed between the handle 310 and the bolt 270 due to the loose fit of the depending portion 326 in the bolt slot 276, the detent means 290 and the torsion spring 330 cooperate to overcome problems which would otherwise result from such play. As has been explained in conjunction with the lock 10, the detent system 290 releasably holds the bolt 270 in position relative to the body member 230 and prevents the bolt 270 from rattling in the presence of vibration. The detent system 290 also operates to releasably hold the handle 310 in its projected position. The detent system 290 additionally functions to assist in effecting final movement of the bolt 270 to its extended and retracted positions. The disengagement which occurs between the bolt 270 and the handle 310 (i.e., between the depending portion 326 and the end walls 279, 277) when the bolt 270 is extended and the handle 310 is nested is advantageous in that it permits the extended position of the bolt 270 and the nested position of the handle 310 to be determined independently of each other.

Several advantages obtain by using the plastic insert 326 to effectively shorten the length of the slot 276. The use of the insert 326 minimizes the need for lubrication and provides a lock with excellent operator "feel" due to the smooth, quiet mannerism in which the depending portion 326 moves when in engagement with the plastic insert 326. The plastic insert 274 is inexpensive to form and provides an extremely simple manner of establishing a relatively small actuator-receiving slot in the bolt 270. By using the insert 326, the need is eliminated to form a relatively small opening in the bolt to receive the depending portion 326. Where the insert 326 is used, a relatively long, inexpensive-to-form slot may be provided in the bolt 270.

As will be apparent to those skilled in the art, modifications can be made in the described lock embodiment without departing from the spirit of the invention. For example, the detent ball and spring 292, 296 may be housed in a plastic sleeve such as is utilized in the lock 10. Alternatively, the length of the bolt slot 276 may be further increased such that plastic insert 326 operates not only to decrease the length of the slot but also to house the detent ball and spring 292, 296. Other modifications will be apparent.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A flush-mountable door lock, comprising:

(a) a body structure having side and back walls which cooperate to define a forwardly facing recess, the back wall having a stepped configuration with a first part defining a relatively shallow recess portion and a second part defining a relatively deeper recess portion, and having an opening formed through the back wall;

(b) an elongate bolt slidably supported on the body structure at a location behind a portion of the back side of the second part, the bolt being movable between an extended position wherein the bolt is extended with respect to the body structure, and a retracted position wherein the bolt is retracted with respect to the body structure, the bolt having a receiving formation commuicating with the back wall opening, the receiving formation being positioned near one end of the back wall opening when the bolt is in its extended position, and being positioned near the other end of the back wall opening when the bolt is in its retracted position;

(c) a paddle-shaped handle pivotally mounted on the body member and being movable between a nested position wherein the handle is nested within the deeper recess portion, and a projected position wherein a substantial portion of the handle projects forwardly of the recess;

(d) detent means interposed between the body structure and the bolt for selectively releasably retaining the bolt in its retracted and extended positions and for assisting in moving the bolt to and positioning the bolt in its retracted and extended positions once the bolt closely approaches these positions;

(e) connecting means extending through the back wall opening and into the receiving formation for establishing a driving interconnection between the handle and the bolt which is operative to move the bolt out of its extended position and toward its retracted position as the handle is moved from its nested position to its projected position, and which is operative to move the bolt out of its retracted position and toward its extended position as the handle is moved from its projected position to its nested position;

(f) biasing means interposed between the body member and the handle:

(i) for biasing the handle toward its nested position;

(ii) for maintaining play-free engagement between the handle and the body structure when the bolt is in its extended position; and, (iii) for maintaining a play-free driving connection between the handle and the bolt when the bolt is in its retracted position; and, (g) the connecting means being operable to disengage the receiving formation when the bolt is extended and the handle is nested, the connection means including bolt actuator means extending through the back wall opening and being operably connected to the handle and to the receiving formation for moving the bolt from its extended position toward its retracted position when the handle is moved from its nested position to its projected position, and for moving the bolt from its retracted position toward its extended position when the handle is moved from its projected position to its nested position, the bolt actuator being operable to disengage the bolt when the bolt is in its extended position and the handle is in its nested position.

2. The door lock of claim 1 additionally including a key control mounted on the body structure and carrying a cam movable between a locked position wherein the cam prevents movement of the bolt to its retracted position, and an unlocked position wherein the cam permits movement of the bolt to its retracted position.

3. The door lock of claim 1 wherein:

(a) the opening formed through the back wall is an elongate slot;

(b) the receiving formation is positioned relatively near one end of the slot when the bolt is in its extended position and is positioned relatively near the other end of the slot when the bolt is in its retracted position; and, (c) the connection means includes an elongate member which is relatively loosely received within the receiving formation.

4. A flush-mountable door lock, comprising:

(a) a body structure having side and back walls which cooperate to define a forwardly facing recess, and having an opening formed through the back wall;

(b) an elongate bolt slidably supported on the body structure at a location behind a portion of the back wall, the bolt being movable between an extended position wherein the bolt is extended with respect to the body structure, and a retracted position wherein the bolt is retracted with respect to the body structure, the bolt having a receiving formation communicating with the back wall opening;

(c) detent means interposed between the body structure and the bolt for selectively releasably retaining the bolt in its retracted and extended positions, and for assisting in moving the bolt to and positioning the bolt in its retracted and extended positions once the bolt closely approaches these positions;

(d) a handle mounted on the body structure and being movable between a nested position wherein the handle is nested within the recess and a projected position wherein a substantial portion of the handle projects from the recess;

(e) connecting means extending through the opening and into the receiving formation for establishing a driving interconnection between the handle and the bolt which is operative to move the bolt out of its extended position and toward its retracted position as the handle is moved from its nested position to its projected position, and which is operative to move the bolt out of its retracted position and toward its extended position as the handle is moved from its projected position to its nested position;

(f) biasing means interposed between the body member and the handle:

(i) for biasing the handle toward its nested position;

(ii) for maintaining play-free engagement between the handle and the body structure when the bolt is in its extended position; and, (iii) for maintaining a play-free driving connection between the handle and the bolt when the bolt is in its retracted position;

(g) the connection means being operable to disengage the receiving formation when the bolt is extended and the handle is nested;

(h) a through-hole formed in the bolt having one end opening toward the body structure;

(i) a mounting sleeve formed from plastics material being carried in the through-hole;

(j) a closed-ended hole being formed in the mounting sleeve and having an open end facing toward the body structure; and, (k) the detent means including a detent member positioned in the closed-ended hole together with spring means biasing the detent member toward the body structure for receiving the detent member when the bolt is in its retracted and extended positions.

5. The door lock of claim 4 wherein the mounting sleeve is pressed into the through-hole and is retained securely therein by virture of its press-fit.

6. The door lock of claim 4 wherein the spaced receiving means include a pair of formations which are configured differently to receive the detent member to different degrees.

7. A flush-mountable door lock, comprising:

(a) a body member having side and back wall portions which define a forwardly facing recess, the back wall having a stepped configuration with a first part defining a relatively shallow recess portion and a second part defining a relatively deeper recess portion;

(b) the body member including structure defining an elongate, open-ended passage on the back side of the second part, and an elongate slot being formed through the second part communicating with the passage;

(c) a bolt slidably supported in the passage and being movable between an extended position wherein one end of the bolt is extended with respect to the passage, and a retracted position wherein the one bolt end is retracted with respect to the passage;

(d) the bolt having a formation which is positioned near one end of the slot when the bolt is in its extended position, and which is positioned near the other end of the slot when the bolt is in its retracted position;

(e) a paddle-shaped handle pivotally mounted on the body member and being movable between a nested position wherein the handle is nested within the deeper recess portion, and a projected position wherein a substantial portion of the handle projects forwardly of the recess;

(f) bolt actuator means extending through the slot and being operably connected to the handle and to the bolt formation for moving the bolt from its extended position toward its retracted position when the handle is moved from its nested position to its projected position, and for moving the bolt from its retracted position toward its extended position when the handle is moved from its projected position to its nested position;

(g) biasing means interposed between the body member and the handle for:

(i) biasing the handle toward its nested position;

(ii) maintaining play-free engagement between the handle and the body member when the handle is in its nested position; and, (iii) maintaining a play-free driving connection between the handle and the bolt when the handle is in its projected position; and, (h) detent means interposed between the body member and the bolt for:

(i) assisting in moving the bolt to and positioning the bolt in its extended position as the bolt closely approaches its extended position;

(ii) assisting in moving the bolt to and positioning the bolt in its retracted position as the bolt closely approaches its retracted position;

(iii) releasably retaining the bolt in its extended position when the handle is in its nested position;

(iv) releasably retaining the bolt in its retracted position when the handle is in its projected position;

(v) releasably retaining the handle in its projected position once the handle has been moved to its projected position and in opposition to the action of the biasing means biasing the handle towards its nested position; and, (vi) the bolt actuator means being operable to disengage the bolt when the bolt is in its extended position and the handle is in its nested position.

8. The door lock of claim 7 additionally including a key control mounted in the first part of the back wall and carrying a cam movable between a locked position wherein the cam prevents movement of the bolt to its retracted position, and an unlocked position wherein the cam permits movement of the bolt to its retracted position.

9. The door lock of claim 7 wherein:

(a) a hole is formed in the bolt at a location removed from the bolt formation and opens toward the body member; and, (b) the detent means includes a detent member positioned in the hole together with spring means biasing the detent member toward the body member, and spaced depression means on the body member for receiving the detent member when the bolt is in its retracted and extended positions.

10. The door lock of claim 7 wherein:

(a) the bolt actuator means includes an elongate member which is rigidly secured to the handle for movement therewith;

(b) the bolt formation comprises an opening formed in the bolt; and, (c) one end of the elongate member projects relatively loosely into the bolt opening.

11. The door lock of claim 10 wherein the bolt formation additionally includes a plastics insert carried in the opening to diminish the effective size of the opening.

12. The door lock of claim 7 wherein:

(a) a through-hole is formed in the bolt and has one end opening toward the body structure;

(b) a mounting sleeve formed from plastics material is carried in the through-hole;

(c) a closed-ended hole is formed in the mounting sleeve and has an open end facing toward the body structure; and, (d) the detent means includes a detent member positioned in the closed-ended hole together with spring means biasing the detent member toward the body structure, and spaced formation means on the body structure for receiving the detent member when the bolt is in its retracted and extended positions.

13. The door lock of claim 12 wherein the mounting sleeve is pressed into the through-hole and is retained securely therein by virtue of the press-fit.

14. The door lock of claim 7 wherein the detent means includes a detent member carried by the bolt, a first receiving formation provided on the body for receiving the detent member when the bolt is in its retracted position, and a second receiving formation provided on the body for receiving the detent member when the bolt is in its extended position.

15. The door lock of claim 14 wherein the first and second receiving formations are differently configured to receive the detent member to different degrees.

* * * * *